US007874867B2

(12) United States Patent
Takahashi et al.

(10) Patent No.: US 7,874,867 B2
(45) Date of Patent: Jan. 25, 2011

(54) ELECTRICAL CONNECTION MEMBER WITH OUTER INSULATING FILM MEMBER AND INNER INCLINED SPRING MEMBER

(75) Inventors: Takuya Takahashi, Tokyo (JP); Ryuzo Shimeno, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/592,356

(22) Filed: Nov. 24, 2009

(65) Prior Publication Data

US 2010/0151744 A1 Jun. 17, 2010

(30) Foreign Application Priority Data

Dec. 12, 2008 (JP) ..... 2008-316484

(51) Int. Cl.
*H01R 12/24* (2006.01)

(52) U.S. Cl. ..... 439/496; 439/77

(58) Field of Classification Search ..... 439/496, 439/493, 495, 67, 77
See application file for complete search history.

(56) References Cited

U.S. PATENT DOCUMENTS

| | | | | |
|---|---|---|---|---|
| 3,629,787 | A * | 12/1971 | Wilson | 439/67 |
| 5,035,628 | A | 7/1991 | Casciotti et al. | 439/66 |
| 5,730,619 | A * | 3/1998 | Hamlin | 439/493 |
| 6,558,186 | B1 * | 5/2003 | LePottier et al. | 439/496 |
| 6,749,459 | B2 * | 6/2004 | Urbaniak et al. | 439/496 |
| 7,121,837 | B2 | 10/2006 | Sato et al. | 439/66 |
| 7,131,861 | B2 * | 11/2006 | Aeschbacher | 439/495 |
| 7,320,617 | B1 * | 1/2008 | Bellato et al. | 439/496 |
| 7,367,838 | B2 | 5/2008 | Takahashi et al. | 439/495 |
| 7,374,429 | B2 | 5/2008 | Cronch et al. | 439/67 |
| 7,540,763 | B2 | 6/2009 | Takahashi et al. | 439/495 |
| 2007/0066092 | A1 * | 3/2007 | Soeta | 439/67 |

FOREIGN PATENT DOCUMENTS

| | | |
|---|---|---|
| GB | 2 298 324 | 8/1996 |
| JP | 02-031523 | 12/1991 |
| JP | 04-229582 | 8/1992 |
| JP | 08-250171 | 9/1996 |
| JP | 2000-231957 | 8/2000 |
| JP | 2004-039406 | 2/2004 |
| JP | 2006-228453 | 8/2006 |
| JP | 2008-539557 | 11/2008 |

OTHER PUBLICATIONS

Japanese Office Action dated Oct. 20, 2010 (in Japanese).

* cited by examiner

*Primary Examiner*—Hae Moon Hyeon
(74) *Attorney, Agent, or Firm*—Collard & Roe, P.C.

(57) ABSTRACT

In an electrical connection member having elasticity and adapted to be interposed between connection objects for electrically connecting them together, an inner member has a plurality of spring pieces each extending from a base plate portion, an outer member including a flexible insulating film and a plurality of conductive paths formed at the flexible insulating film. Each conductive path has a first and a second contact portion for connection to the connection objects. Each spring piece includes a root portion formed adjacent to the base plate portion and faced to a portion, corresponding to the second contact portion, of an inner surface of an intermediate portion of the insulating film. Each spring piece further includes an inclined spring portion extending obliquely from the root portion and faced to a portion, corresponding to the first contact portion, of the inner surface of the intermediate portion.

7 Claims, 10 Drawing Sheets

ELECTRICAL CONNECTION MEMBER WITH OUTER INSULATING FILM MEMBER AND INNER INCLINED SPRING MEMBER

CROSS-REFERENCE TO RELATED APPLICATIONS

This application is based upon and claims the benefit of priority from Japanese Patent Application No. 2008-316484, filed on Dec. 12, 2008, the disclosure of which is incorporated herein in its entirety by reference.

TECHNICAL FIELD

This invention relates to an electrical connection member adapted to be interposed between two connection objects for electrically connecting them together.

BACKGROUND ART

One example of this type of electrical connection member is disclosed in JP-A-2006-228453 (Patent Document 1). The disclosed electrical connection member comprises a plate-like base member, elastic members fixed to both surfaces of the base member, respectively, and a film member wound around these elastic members. Conductive paths extending between both sides of the base member are formed on an outer surface of the film member. Contact portions are formed at both ends of each conductive path on both sides of the base member.

In use, the electrical connection member is disposed between two connection objects and then the two connection objects are pressed in directions approaching each other. As a result, the contact portions are brought into contact with the connection objects so that the connection objects are electrically connected together through the conductive paths of the electrical connection member.

SUMMARY OF THE INVENTION

According to the electrical connection member disclosed in Patent Document 1, however, since the electrical connection is obtained by merely pressure-contacting the contact portions with the connection objects, if dust or foreign matter is adhering to the connection object or the contact portion, the contact therebetween becomes unstable so that there arises a problem in connection between the connection object and the contact portion.

It is therefore an exemplary object of this invention to provide an electrical connection member having a function to remove a contaminant or foreign matter on a connection object or contact portions.

Other objects of the present invention will become clear as the description proceeds.

According to an exemplary aspect of the present invention, there is provided an electrical connection member having elasticity and adapted to be interposed between a first connection object and a second connection object for electrically connecting them together, wherein the electrical connection member comprises an inner member and an outer member, wherein the inner member comprises a base plate portion and a plurality of spring pieces each extending from the base plate portion, wherein the outer member comprises a flexible insulating film which comprises both end portions which is respectively positioned on both sides of the base plate portion and an intermediate portion which surrounds the spring pieces collectively, and a plurality of conductive paths which are formed at the intermediate portion, wherein each of the conductive paths comprises a first contact portion for connection to the first connection object and a second contact portion for connection to the second connection object, and wherein each of the spring pieces comprises a root portion which is formed adjacent to the base plate portion and faced to a portion that corresponds to the second contact portion and is of an inner surface of the intermediate portion, and an inclined spring portion which extends obliquely from the root portion and is faced to a portion that corresponds to the first contact portion and is of the inner surface of the intermediate portion.

In the case of an electrical connection member according to the exemplary aspect of this invention, when connecting a first and a second connection object to each other, first contact portions slide on the first connection object to remove a contaminant or foreign matter on the first contact portions or electrodes of the first connection object so that it is possible to reduce the connection problem.

DESCRIPTION OF THE EMBODIMENTS

Figure 1:
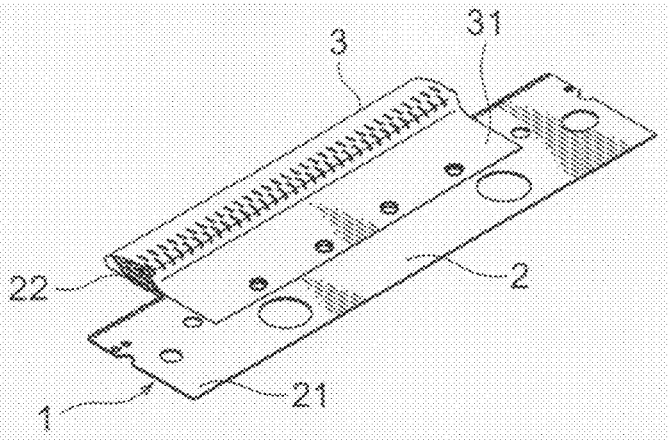
FIG. 1 is a perspective view of an electrical connection member according to a first embodiment of this invention.
Figure 2:
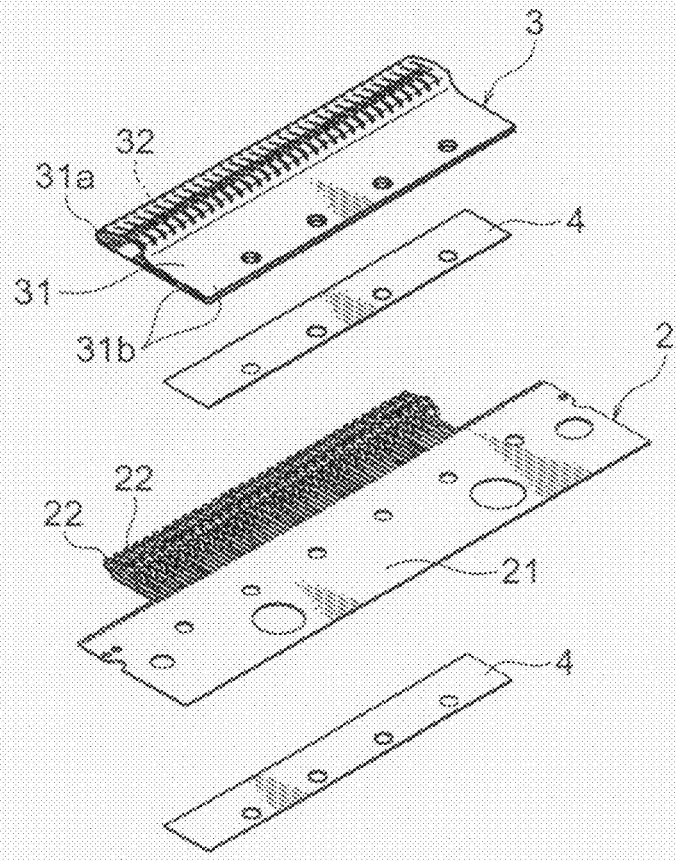
FIG. 2 is an exploded perspective view of the electrical connection member of FIG. 1.
Figure 3:
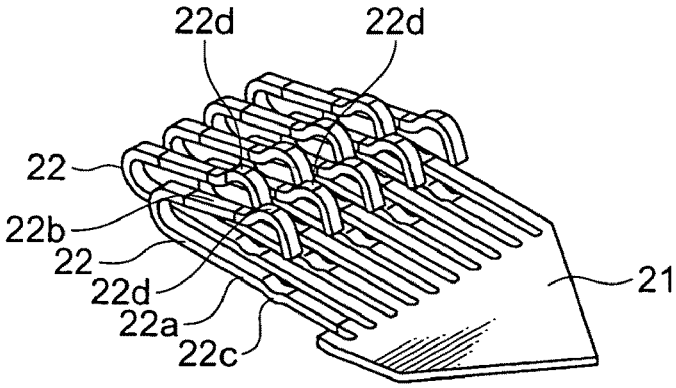
FIG. 3 is a perspective view showing part of an inner member included in the electrical connection member of FIG. 1.
Figure 4:
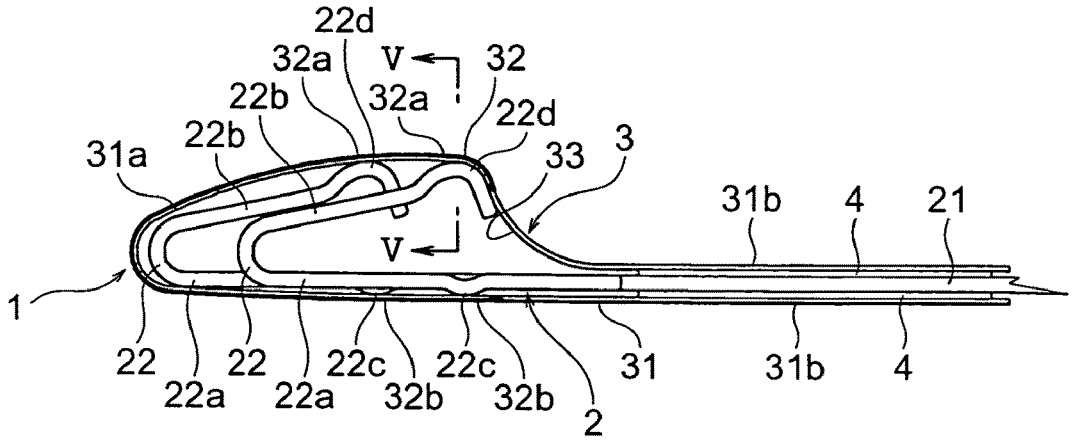
FIG. 4 is a side view of the electrical connection member of FIG. 1.
Figure 5:
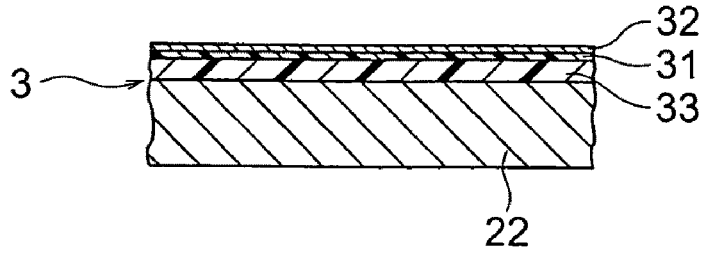
FIG. 5 is an enlarged sectional end face view taken along line V-V in FIG. 4.
Figure 6:
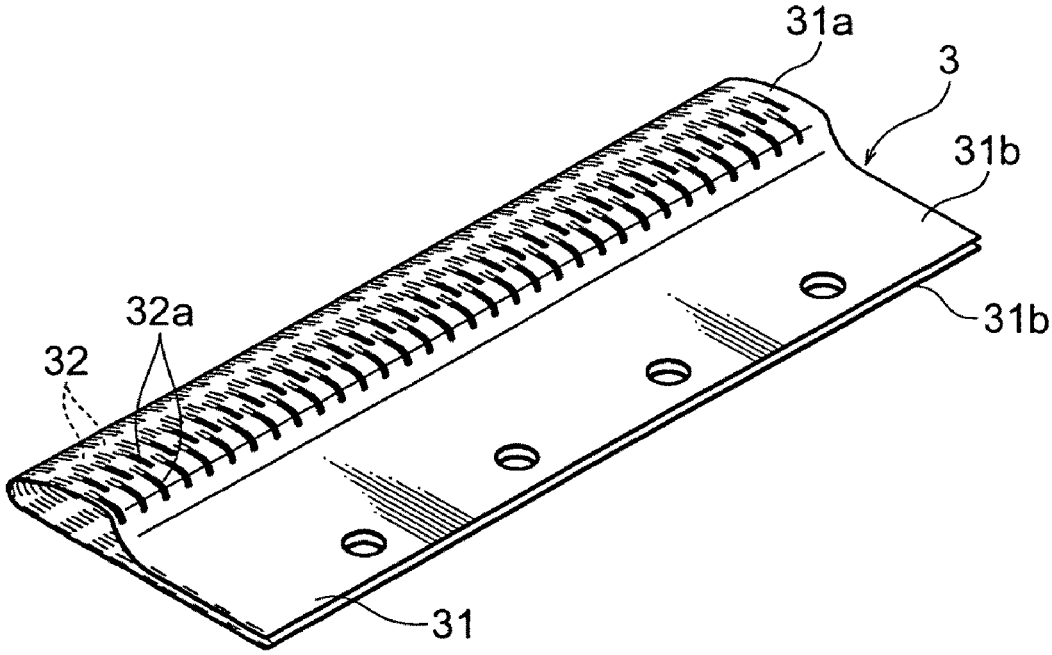
FIG. 6 is a perspective view of an outer member included in the electrical connection member of FIG. 1.
Figure 7:
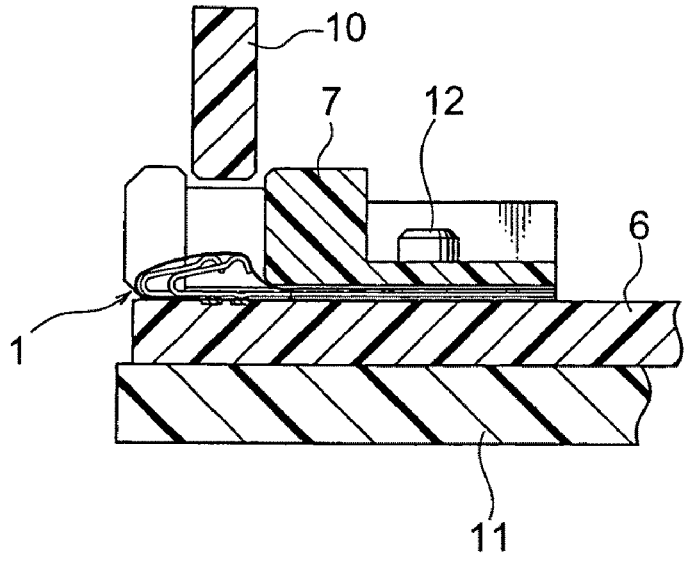
FIG. 7 is a sectional side view of a connecting device, before use, including the electrical connection member of FIG. 1.
Figure 8:
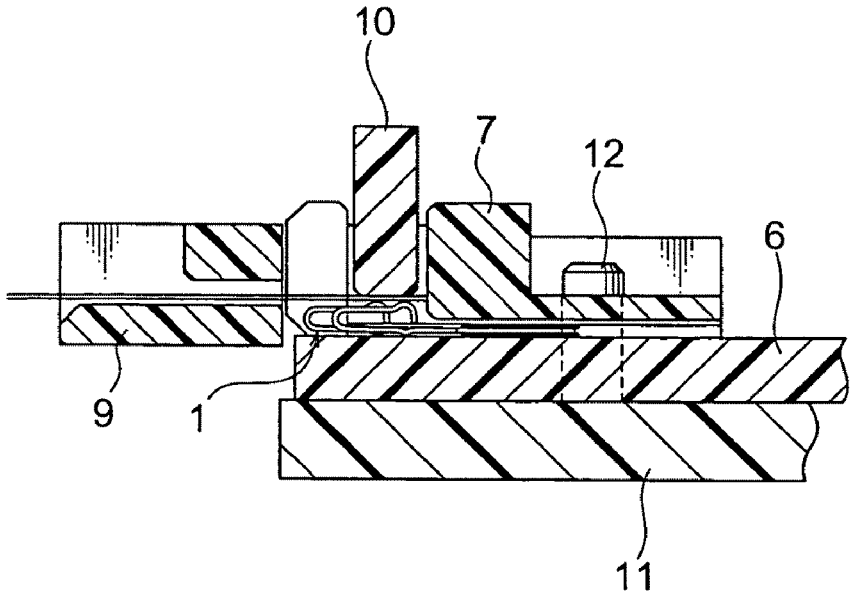
FIG. 8 is a sectional side view of the connecting device of FIG. 7 in use.
Figure 9:
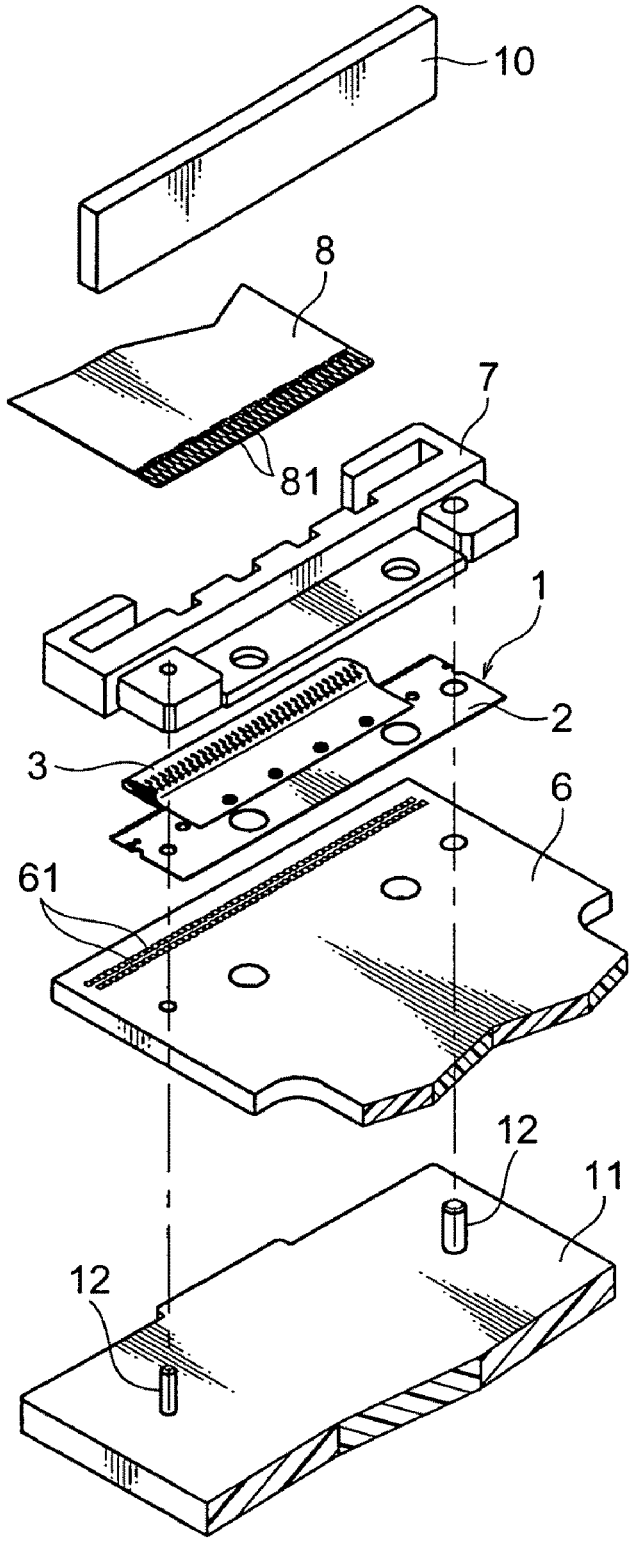
FIG. 9 is an exploded perspective view of FIG. 8.
Figure 10:
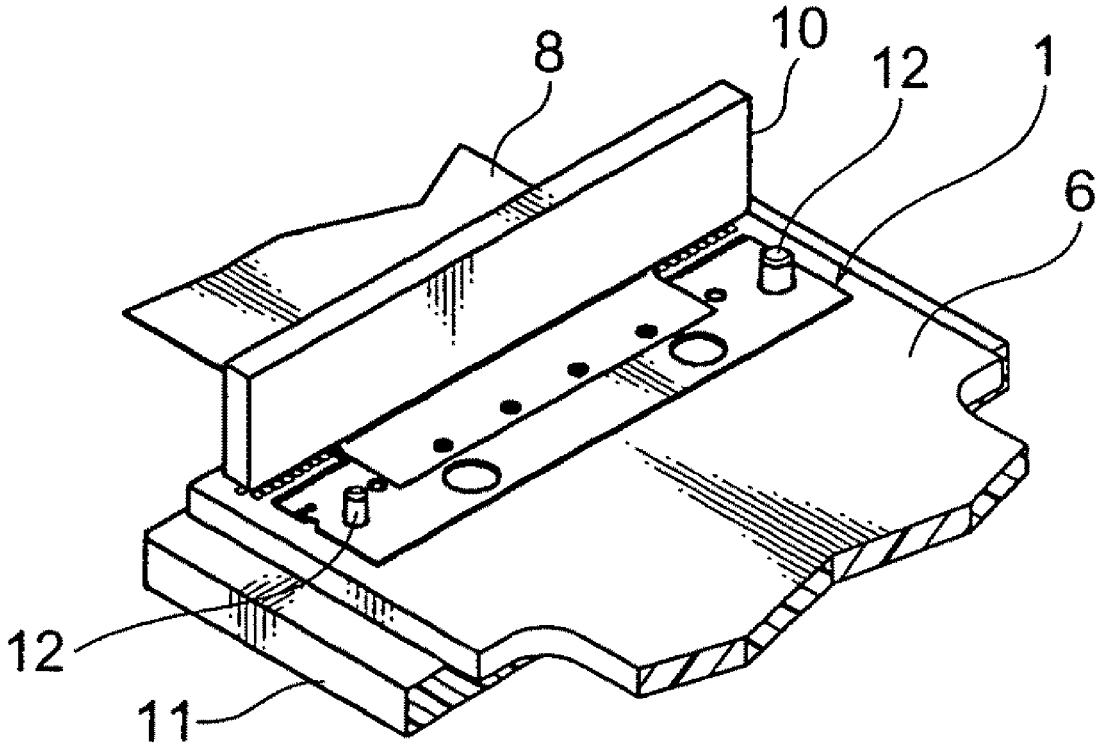
FIG. 10 is a perspective view showing a state of the connecting device of FIG. 7 in use, with part of components removed.

Referring to the drawings, a description will be given of electrical connection members according to embodiments of this invention and connecting devices each adapted to electrically connect a first and a second connection object to each other using one of the electrical connection members.

Referring to FIGS. 1 to 6, an electrical connection member 1 according to a first embodiment of this invention comprises a combination of an inner member 2 and an outer member 3 which will be described in detail hereinbelow. The inner member 2 is formed by punching a springy metal plate and has a base plate portion 21 in the form of a rectangular plate and a number of spring pieces 22 in the form of plate springs each extending from one side of the base plate portion 21.

Each spring piece 22 has a root portion 22*a* extending from the base plate portion 21 and an inclined spring portion 22*b* folded back from a distal end of the root portion 22*a* and then extending obliquely. The root portion 22*a* and the inclined spring portion 22*b* are formed with outward convex portions 22*c* and 22*d*, respectively. Particularly, the convex portion 22*d* of the inclined spring portion 22*b* is formed by providing the spring piece 22 with a bent portion. In the spring pieces 22, the convex portions 22*c* are arranged in zigzag in two rows and the convex portions 22*d* are also arranged in zigzag in two rows so that the interval between the adjacent convex portions 22*c* and the interval between the adjacent convex portions 22*d* are set large enough to prevent a short circuit.

On the other hand, the outer member 3 has a flexible insulating film 31. The insulating film 31 is formed by bending a single plastic film member. The insulating film 31 has an intermediate portion 31*a* surrounding the spring pieces 22 collectively. Particularly, the intermediate portion 31*a* is bent along the bent portions forming the convex portions 22*d* at the inclined spring portions 22*b*. Both end portions 31*b* of the insulating film 31 are disposed on both sides of the base plate portion 21, respectively, and fixed to the base plate portion 21 by fixing tape members 4, respectively. It is to be noted that the intermediate portion 31*a* is slightly slackened or sagged.

A number of conductive paths 32 are formed at the intermediate portion 31*a* of the insulating film 31. Each conductive path 32 has a first contact portion 32*a* for connection to a first connection object and a second contact portion 32*b* for connection to a second connection object. The first contact portion 32*a* and the second contact portion 32*b* are exposed on an outer surface of the intermediate portion 31*a* of the insulating film 31, but the other portion of each conductive path 32 passes through a corresponding one of through holes (not illustrated) formed in the insulating film 31 and extends along an inner surface of the intermediate portion 31*a*. An insulating elastic sheet 33 is bonded to the inner surface of the intermediate portion 31*a* of the insulating film 31 to cover the conductive paths 32, thereby strengthening the insulation.

The convex portion 22*c* provided at the root portion 22*a* of each spring piece 22 is in abutment with a portion, corresponding to the second contact portion 32*b*, of a surface of the elastic sheet 33 at the intermediate portion 31*a*, thereby supporting the second contact portion 32*b*. On the other hand, the convex portion 22*d* provided at the inclined spring portion 22*b* of each spring piece 22 is in abutment with a portion, corresponding to the first contact portion 32*a*, of the surface of the elastic sheet 33 at the intermediate portion 31*a*, thereby supporting the first contact portion 32*a*.

Herein, the spring pieces 22 are in one-to-one correspondence with the conductive paths 32, but it may be designed that at least one of the spring pieces 22 corresponds to a plurality of conductive paths 32 among all the conductive paths 32.

Referring also to FIGS. 7 to 10, a connecting device for electrically connecting the first and second connection objects to each other using the electrical connection member 1 comprises a circuit board 6 having a number of electrode pads 61 arranged in zigzag in two rows and exposed on an upper surface thereof and a guide member 7 mounted on the circuit board 6. The electrical connection member 1 is partially sandwiched and fixed between the circuit board 6 and the guide member 7.

Herein, an FPC (flexible printed circuit) 8 is used as the first connection object. The FPC 8 has, at its end portion, a number of electrode pads 81 arranged in zigzag in two rows and exposed on a lower surface thereof. The end portion of the FPC 8 is placed on an exposed portion of the electrical connection member 1 using a jig 9 and is pressed downward using a vertically movable pressing member 10. As a result, the electrode pads 81 of the FPC 8 are brought into pressure contact with the first contact portions 32*a* of the electrical connection member 1, respectively. Simultaneously, the second contact portions 32*b* of the electrical connection member 1 are brought into pressure contact with the electrode pads 61 of the circuit board 6, respectively.

In this manner, the FPC 8 is electrically connected to the circuit board 6 through the electrical connection member 1. That is, the electrical connection member 1 is interposed between the FPC 8 and the circuit board 6 and electrically connects them together. In this case, the circuit board 6 can be regarded as the second connection object. This connecting device can be used as an inspection device for inspecting the conducting state of the FPC 8.

The positional relationship among the electrical connection member 1, the circuit board 6, and the guide member 7 is determined by a positioning member 11. Specifically, positioning pins 12 provided on the positioning member 11 are slidably inserted into through holes provided in each of the electrical connection member 1, the circuit board 6, and the guide member 7.

Figure 11:
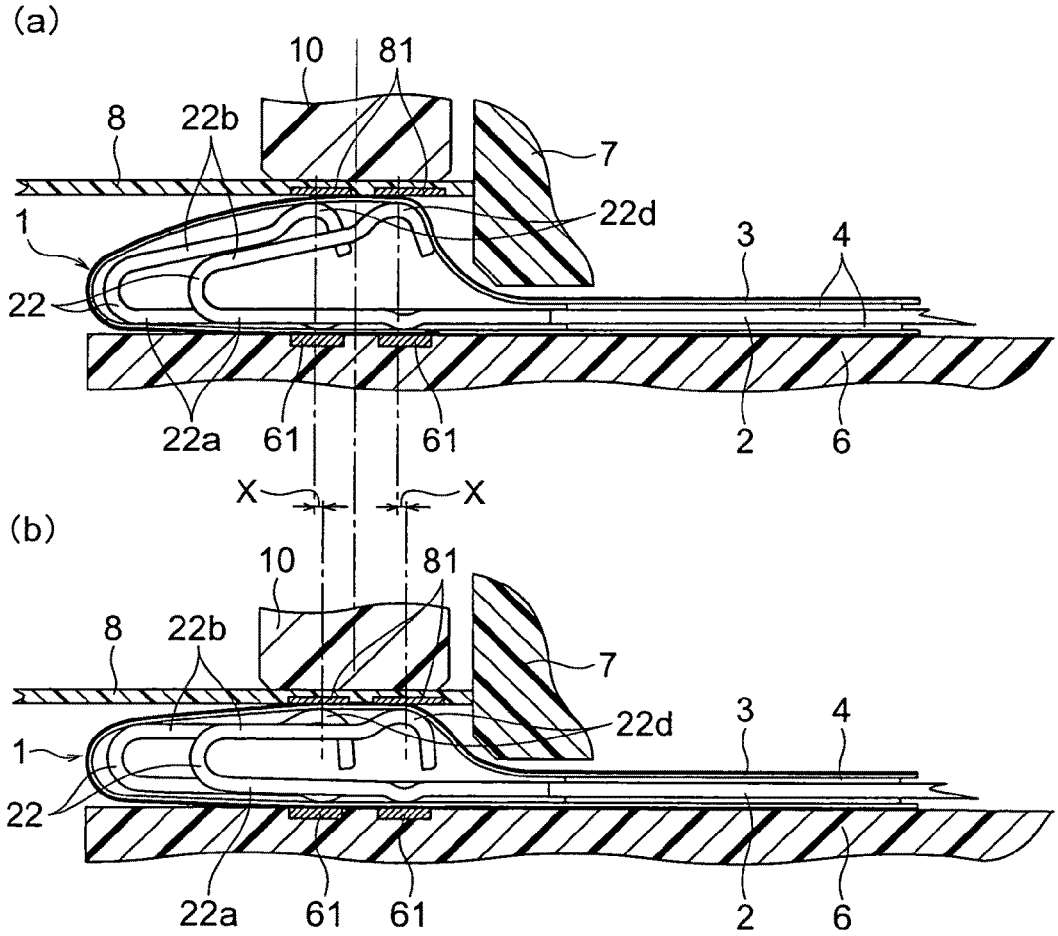
FIG. 11 is an explanatory main-portion enlarged sectional view showing, in the connecting device illustrated in FIGS. 7 to 10, a state (a) where an end portion of an FPC is placed on an exposed portion of the electrical connection member and a state (b) where the end portion of the FPC is pressed against the exposed portion of the electrical connection member.

FIG. 11 shows a state (a) where the end portion of the FPC 8 is placed on the exposed portion of the electrical connection member 1 and a state (b) where the end portion of the FPC 8 is pressed against the exposed portion of the electrical connection member 1.

In FIG. 11, when the FPC 8 is pressed onto the electrical connection member 1 from the upper side, the inclined spring portion 22*b* of each spring piece 22 is inclined downward using its portion joined to the root portion 22*a* as a fulcrum. In this event, following the movement of the convex portion 22*d* of the inclined spring portion 22*b*, the portion, abutting the convex portion 22*d*, of the elastic sheet 33 and the first contact portion 32*a* of the insulating film 31 are slightly moved to the right along the surface of the drawing sheet by a movement amount X. Thus, the first contact portion 32*a* slides on the electrode pad 81 of the FPC 8 to perform a wiping operation to remove a contaminant or foreign matter on the first contact portion 32*a* or the electrode pad 81 (see FIG. 4).

According to the electrical connection member 1 described above, the following advantages are achieved:

1. Since the electrical connection member 1 has the function to remove dust or foreign matter, it is possible to reduce the connection problem due to the contaminant or foreign matter.

2. Since the spring pieces 22 are in the form of the metal springs, the long lifetime can be expected for a use such as an inspection connector which is repeatedly connected and detached.

3. By forming the bent portion at the distal end of the inclined spring portion 22*b* of each spring piece 22, it is possible to make the movement of the first contact portion 32*a* smooth and thus to prevent damage to the insulating film 31 due to an excessive load.

4. Since the spring pieces 22 operate independently of each other for the conductive paths 32, respectively, the followability to strain, warp, or the like of the electrical connection member 1 is made excellent and thus it is possible to improve the connection reliability.

5. By increasing the size of each spring piece 22 to correspond to a plurality of conductive paths 32, it is possible to solve a problem of reduction in springiness due to miniaturization of the spring pieces 22 following miniaturization of the electrical connection member 1 and thus to enhance the connection reliability.

6. By disposing the elastic sheet 33 on the inner surface of the insulating film 31 so as to support the first contact portions 32*a* by the inclined spring portions 22*b* through the elastic sheet 33, the degree of surface contact is made large when the first contact portions 32*a* are brought into contact with the electrode pads 81 of the FPC 8 and therefore it is possible to prevent damage to mutual contact surfaces of the electrode pads 81 and the first contact portions 32*a* and thus to enhance the contact reliability.

Figure 12:
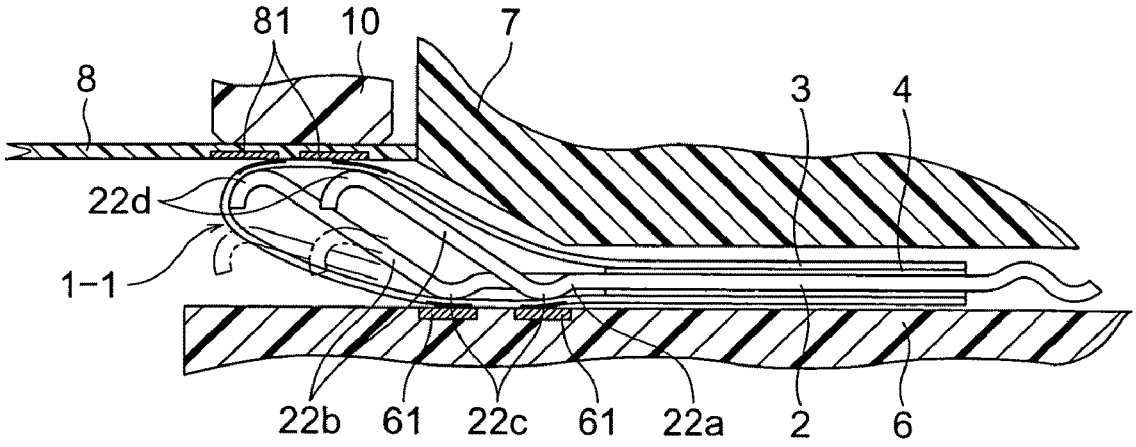
FIG. 12 is a sectional view showing only a main portion of a connecting device including an electrical connection member according to a second embodiment of this invention.
Figure 13:
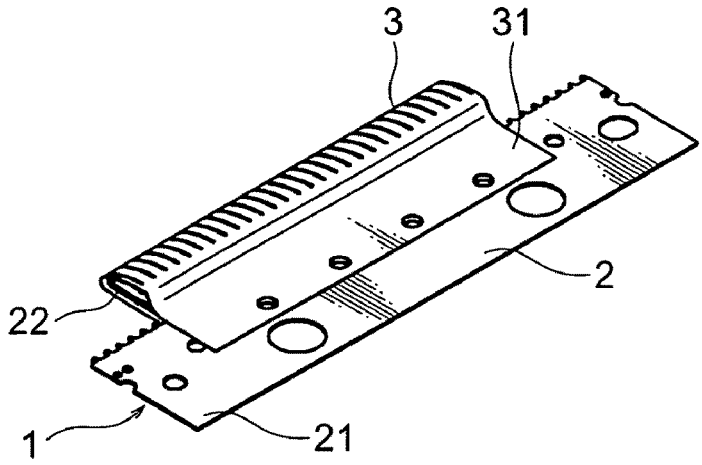
FIG. 13 is a perspective view of an electrical connection member according to a third embodiment of this invention.
Figure 14:
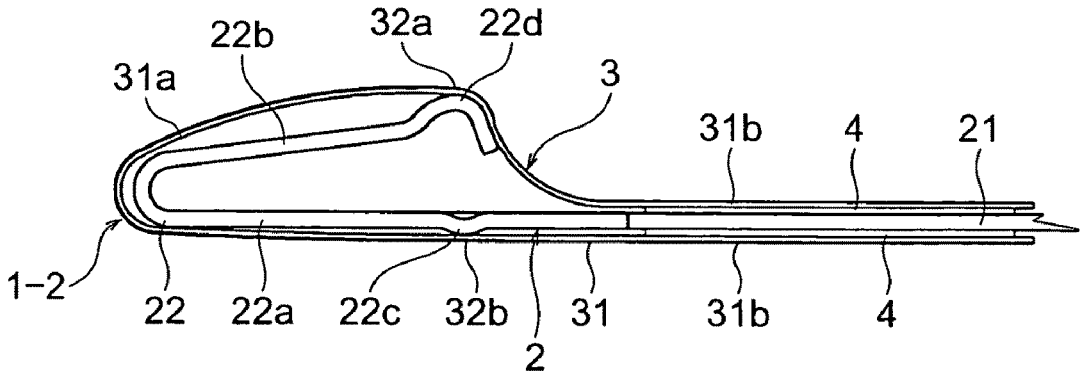
FIG. 14 is a side view of the electrical connection member of FIG. 13.
Figure 15:
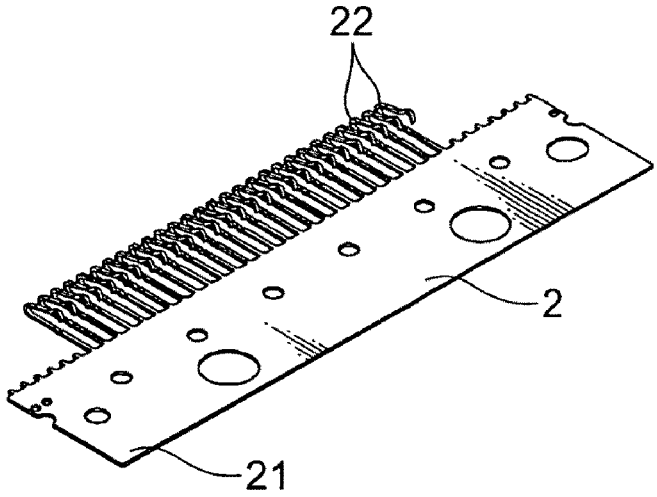
FIG. 15 is a perspective view of an inner member included in the electrical connection member of FIG. 13.
Figure 16:
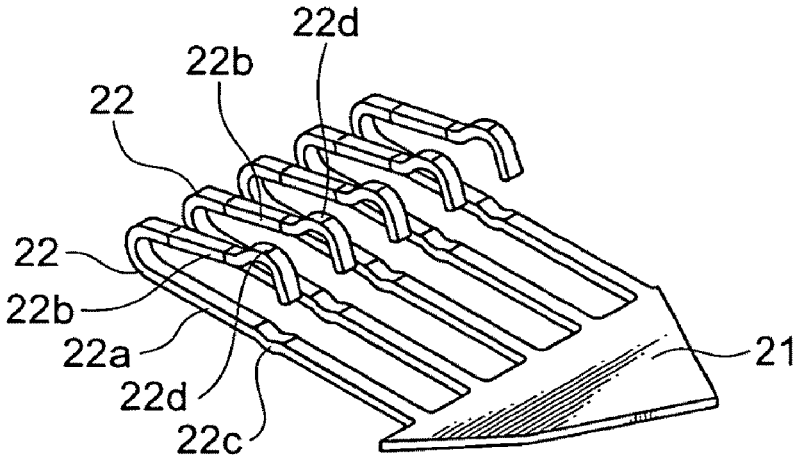
FIG. 16 is an enlarged perspective view of only a main portion of the inner member of FIG. 15.

Referring now to FIG. 12, an electrical connection member according to a second embodiment of this invention will be described. The same reference symbols are assigned to the same or similar portions, thereby omitting description thereof.

In the electrical connection member 1 described using FIGS. 1 to 6, the inclined spring portion 22*b* of each spring piece 22 is folded back with respect to the root portion 22*a* and thus is largely bent. On the other hand, in an electrical connection member 1-1 used in a connecting device shown in FIG. 12, an inclined spring portion 22*b* of each spring piece 22 is bent a little with respect to a root portion 22*a* so as to extend forward.

According to this electrical connection member 1-1, advantages equivalent to those of the electrical connection member 1 described using FIGS. 1 to 6 are also achieved.

Referring now to FIGS. 13 to 16, an electrical connection member according to a third embodiment of this invention will be described. The same reference symbols are assigned to the same or similar portions, thereby omitting description thereof.

In the electrical connection member 1 described using FIGS. 1 to 6, the convex portions 22*c* and 22*d* of the spring pieces 22 are arranged in zigzag, respectively. On the other hand, in an electrical connection member 1-2 shown in FIGS. 13 to 16, convex portions 22*c* and 22*d* of spring pieces 22 are arranged linearly, respectively. Therefore, first contact portions 32*a* and second contact portions 32*b* are also arranged linearly, respectively. The other structure is the same as that of the electrical connection member 1 described using FIGS. 1 to 6.

According to this electrical connection member 1-2, advantages equivalent to those of the electrical connection member 1 described using FIGS. 1 to 6 are also achieved.

Any of the above-mentioned electrical connection members is not only usable as an inspection device for inspecting the conducting state of an FPC or the like, but also applicable as a component of various connectors.

Various exemplary embodiments of this invention will be enumerated in the following items 1-8.

1. An electrical connection member 1 having elasticity and adapted to be interposed between a first connection object 8 and a second connection object 6 for electrically connecting them together, wherein the electrical connection member comprises an inner member 2 and an outer member 3, wherein the inner member 2 comprises:

a base plate portion 21; and a plurality of spring pieces 22 each extending from the base plate portion 21, wherein the outer member 3 comprises:

a flexible insulating film 31 which comprises:

both end portions 31*b* which is respectively positioned on both sides of the base plate portion 21; and an intermediate portion 31*a* which surrounds the spring pieces 22 collectively; and a plurality of conductive paths 32 which are formed at the intermediate portion 31*a*, wherein each of the conductive paths 32 comprises:

a first contact portion 32*a* for connection to the first connection object 8; and a second contact portion 32*b* for connection to the second connection object 6; and wherein each of the spring pieces 22 comprises:

a root portion 22*a* which is formed adjacent to the base plate portion 21 and faced to a portion that corresponds to the second contact portion 32*b* and is of an inner surface of the intermediate portion 31*a*; and an inclined spring portion 22*b* which extends obliquely from the root portion 22*a* and is faced to a portion that corresponds to the first contact portion 32*a* and is of the inner surface of the intermediate portion 31*a*.

2. The electrical connection member according to item 1, wherein the inclined spring portion 22*b* comprises a convex portion 22*d* which faces a portion corresponding to the first contact portion 32*a*, and the insulating film 31 is bent along the convex portion 22*d*.

3. The electrical connection member according to item 1, wherein the spring pieces 22 are in one-to-one correspondence with the conductive paths 32.

4. The electrical connection member according to item 1, wherein at least one of the spring pieces 22 corresponds to ones of the conductive paths 32.

5. The electrical connection member according to item 1, wherein the outer member 3 comprises an elastic sheet 33 which is disposed on the inner surface of at least the intermediate portion 31*a* of the insulating film 31, and each of the spring pieces 22 is in abutment with the elastic sheet 33.

6. The electrical connection member according to item 1, wherein the root portion 22*a* is in abutment with the outer member 3 to support the second contact portion 32*b*, and the inclined spring portion 22*b* is in abutment with the outer member 3 to support the first contact portion 32*a*.

7. The electrical connection member according to item 1, further comprising fixing members 4 which fixe the both end portions of the insulating film 31 of the outer member 3 to both surfaces of the base plate portion 21 of the inner member 2, respectively.

8. The electrical connection member according to item 1, wherein the inner member 2 is formed by punching a springy metal plate.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. An electrical connection member having elasticity and adapted to be interposed between a first connection object and a second connection object for electrically connecting them together, wherein said electrical connection member comprises an inner member and an outer member, wherein said inner member comprises:

a base plate portion; and a plurality of spring pieces each extending from said base plate portion, wherein said outer member comprises:

a flexible insulating film which comprises:

first and second end portions respectively positioned on both sides of said base plate portion; and an intermediate portion which surrounds said spring pieces collectively;

a plurality of conductive paths which are formed at said intermediate portion, an insulating elastic sheet disposed on an inner surface of at least said intermediate portion of said insulating film, each of said spring pieces being in abutment with said elastic sheet; and wherein each of said conductive paths comprises:

a first contact portion for connection to said first connection object; and a second contact portion for connection to said second connection object; and wherein each of said spring pieces comprises:

a root portion which is formed adjacent to said base plate portion and faced to a portion that corresponds to said second contact portion and is of the inner surface of said intermediate portion; and an inclined spring portion which extends obliquely from said root portion and is faced to a portion that corresponds to said first contact portion and is of the inner surface of said intermediate portion.

2. The electrical connection member according to claim 1, wherein said root portion comprises a first convex portion and said inclined spring portion comprises a second convex portion which faces a portion corresponding to said first contact portion, and said insulating film is bent along said second convex portion.

3. The electrical connection member according to claim 1, wherein said spring pieces are in one-to-one correspondence with said conductive paths.

4. The electrical connection member according to claim 1, wherein at least one of said spring pieces corresponds to ones of said conductive paths.

5. The electrical connection member according to claim 1, wherein said root portion is in abutment with said outer member to support said second contact portion, and said inclined spring portion is in abutment with said outer member to support said first contact portion.

6. The electrical connection member according to claim 1, further comprising fixing members which fix said first and second end portions of said insulating film of said outer member to both surfaces of said base plate portion of said inner member, respectively.

7. The electrical connection member according to claim 1, wherein said inner member is formed by punching a springy metal plate.

* * * * *